United States Patent [19]

Williams

[11] Patent Number: 4,566,639

[45] Date of Patent: Jan. 28, 1986

[54] CENTER FEED MATERIAL GRINDING MILL

[75] Inventor: Robert M. Williams, Ladue, Mo.

[73] Assignee: Williams Patent Crusher and Pulverizer Company, St. Louis, Mo.

[21] Appl. No.: 644,579

[22] Filed: Aug. 27, 1984

[51] Int. Cl.[4] ..... B02C 13/288

[52] U.S. Cl. ..... 241/52; 241/57; 241/80; 241/189 R

[58] Field of Search ..... 241/52, 53, 57, 186 R, 241/186 A, 79.1, 186.3, 190, 189 R, 97, 80

[56] References Cited

U.S. PATENT DOCUMENTS

| | | | |
|---|---|---|---|
| 1,104,121 | 7/1914 | Knoblock . | |
| 2,041,188 | 5/1936 | Johnson | 241/52 X |
| 2,546,286 | 3/1951 | Zakel | 241/52 X |
| 2,931,581 | 4/1960 | Lykken et al. | 241/52 |
| 3,310,059 | 3/1967 | Grinzinger | 241/52 X |

FOREIGN PATENT DOCUMENTS 364084 2/1936 Japan .

*Primary Examiner*—Mark Rosenbaum

*Attorney, Agent, or Firm*—Gravely, Lieder & Woodruff

[57] ABSTRACT

A material grinding mill having a grinding chamber with a closed bottom, a material feed disposed to force ground material to move axially of the rotary grinder to an outlet at one or both sides of the grinding chamber, a scroll liner directed to lie adjacent the path of rotation of the grinder and form a venturi throat inlet to the grinding chamber, a supply of drying medium admitted to the mill to be sucked through the venturi throat for drying the material during the grinding while moving it through the side outlet, and a classifier for returning oversize material to the grinding chamber through the venturi throat.

6 Claims, 2 Drawing Figures

CENTER FEED MATERIAL GRINDING MILL

BACKGROUND OF THE INVENTION

1. Field of the Invention

This invention pertains to improvements in center feed material grinding mills having a closed bottom and an opposite side outlet for ground material.

2. Description of the Prior Art

Pertinent prior art is represented by Lykken et al U.S. Pat. No. 2,931,581 of Apr. 5, 1960 in which a rotary grinder is fed with material to be ground and air at the same side of the rotor, and in which the rotor acts as a fan for propelling the fine material as a result of the grinding in an upward direction aided by the lifting of incoming air. The grinder is provided with a classifier vertically above the grinder rotor with provision for returning heavier and oversize material back to the chamber for further grinding. The return of the heavier and oversize material is determined by gravity separation from the classifier.

A further example of the prior art is represented by Knoblock U.S. Pat. No. 1,104,121 of July 21, 1914 wherein a rotor is fed with material on one side of a grinding chamber and air is circulated by fan at a circumferentially spaced position of the grinding chamber so that the material ground by the rotor is propelled upwardly in a classifying chamber which has spaced outlets for capturing the ground material depending on its size and the distance that the material is thrown up in the chamber. A further example of the prior art is represented by Japanese Pat. No. 36-4084 of Feb. 27, 1936, and in which the arrangement of the operating parts and the housing structure is somewhat similar to the disclosure in Lykken et al.

Patents of lesser pertinence are Williams U.S. Pat. No. 3,794,251 of Feb. 26, 1974, and U.S. Pat. No. 3,826,208 of July 30, 1974. In these patents the grinding chamber has a closed bottom and a center feed through a venturi throat with the air supply located below the throat and above the grinding chamber.

BRIEF SUMMARY OF THE INVENTION

An important object of the present invention is to obtain grinding and material drying in a simple mill arranged to grind and agitate the material during the grinding phase so a drying medium can be brought into the ground material as it enters as well as it leaves the grinding chamber in a flow stream that is divided to pass out of the mill in two flow streams at each side of the material supply and supply of drying medium.

Another important object of the present invention is to provide an arrangement in the mill for allowing the incoming material to enter the grinding chamber substantially centrally so as to push the material laterally along the rotor in the grinding chamber toward side exits, and at the same time provide for a better usage of the drying medium in the grinding chamber.

A preferred embodiment comprises a mill having a grinding chamber open in its central region to receive material to be ground, and to receive as well drying medium such as hot air which also acts as the carrier for the ground material, and side outlets from the grinding chamber so that the incoming drying medium can continue the drying process.

BRIEF DESCRIPTION OF THE DRAWINGS

A preferred embodiment of the present invention is disclosed in the accompanying drawings, wherein.

DETAILED DESCRIPTION OF THE EMBODIMENT

Figure 1:
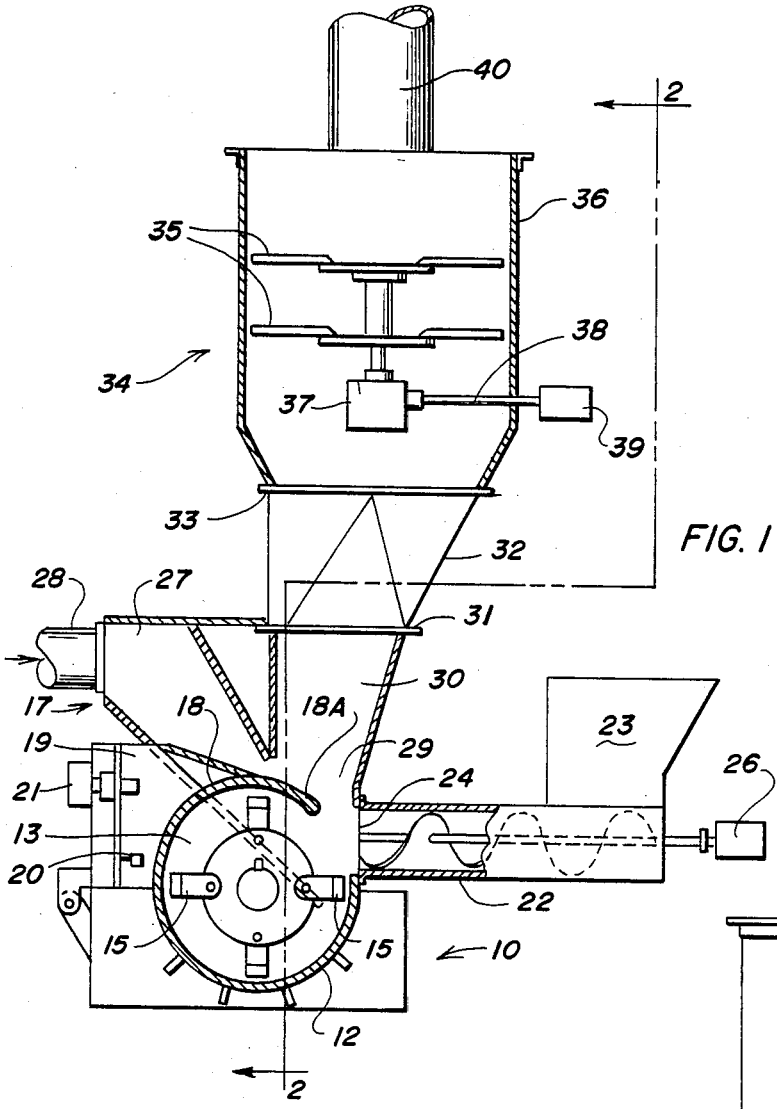
FIG. 1 is a schematic and partial sectional view of the material grinding mill for carrying out the principles of the invention.

The presently preferred character of material grinding mill includes a base frame 10 having opposite side walls 11 and a semi-cylindrical bottom liner 12 extending between said side walls 11 which encloses the bottom of a material grinding chamber 13. The base frame 10 supports a shaft 14 extending axially of the chamber 13 and carried in suitable bearings (FIG. 2), and a rotating assembly of hammers 15 secured on the shaft 14 between retainers 16. However, any suitable hammer assembly may be used.

The mill includes a superstructure 17 mounted on the base frame to enclose a cylindrical form of a scroll liner 18 supported in an adjustable carrier 19 that allows the scroll liner 18 to be moved closer to the circular path of the hammers 15 as wear takes place or as more vacuum or suction in area 29 is required. The scroll 18 and its carrier 19 does not extend to the side walls 11 but is narrower than the closed liner 12 to the extent that it only extends across the face of the hammers. The scroll 18 is movable in the superstructure 17 about a pivot 20 by a suitable adjusting mechanism 21. The scroll liner 18 extends over the path of the hammers 15 and is formed at its front margin with a bulbous terminal edge 18A that closes down close to the path of travel of the hammers 15 in the grinding chamber to produce an acceleration in the flow at the edge 18A. The open portion of the hammer path is located off the edge 18A and opposite the material feed pipe 22, which extends from a hopper 23 to the inlet 24, and is located centrally of the width of the grinding chamber. The material is moved into the grinding chamber 12 by an auger or screw 25 driven by a suitable motor 26. An important feature is the forming of the scroll liner 18 to be narrower (FIG. 2) than the bottom liner 12, thereby opening up at least one space at a side wall 11. It is preferred to have a narrow scroll liner 18 to form spaces at each side wall 11.

Part of the superstructure 17 comprises an air plenum 27 having an inlet for a supply conduit 28. A material drying medium, or hot air of an inert character, is admitted to the plenum so it can flow down over the scroll 18 and combine with the incoming material from the feed pipe 22 at an inlet which functions as a venturi throat 29 under a negative pressure. The negative pressure is generated by the fan effect of the hammers 15 passing the scroll 18 and its close fitted edge 18A whereby a suction is drawn at the venturi throat 29. Another part of the superstructure 17 is an expansion chamber for ground material and air in the form of a rectangular outlet passage 30 leading from the throat 29 of the grinding chamber 12 to a flange 31 which is adapted to form a connection with a transition conduit section 32 which changes shape from rectangular at flanges 31 to circular at its outlet flange 33.

The flange 33 is adapted to support classifying means such as a spinner separator assembly 34 of known type in which rotary fans 35 in the casing 36 are driven by a common transmission 37 having a drive shaft 38 extending to the exterior where it can be connected to a motor 39. The fans 35 have blades that fluidize the flow of ground material and cause the heavy and oversize particles to move to the periphery of the casing 36 and fall by gravity back to the grinding chamber 13 through the venturi throat 29 for further reduction by the hammers 14. The final material outlet 40 is at the top of the casing 36, and this outlet may be connected to a collection station or the ground material may be used as a fuel by being conducted to a burner. A fan or blower (not shown) can be connected to the hot air inlet conduit 28 or connected to the classifier outlet 40.

Figure 2:
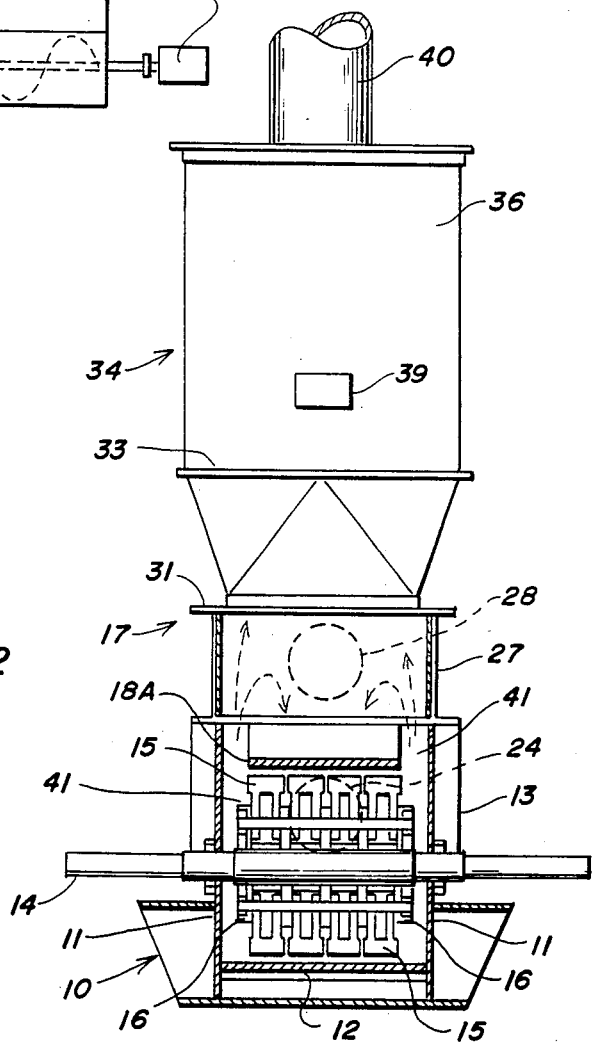
FIG. 2 is a fragmentary sectional view taken along line 2—2 in FIG. 1.

While the paths of material feed and flow of drying medium are shown in side elevation in FIG. 1, the view of FIG. 2 discloses other important characteristics of the invention. There is shown in phantom outline at 24 the material feed inlet located substantially centrally of the grinding chamber so that as the material enters and is ground by the rotor hammers, more incoming material will force the ground material to divide and travel laterally toward the opposite ends of the shaft 14 at the side walls 11. The material thus forced out is contacted simultaneously with the drying medium which enters the throat 29 before moving vertically in the opposite side spaces 41. That side flow reaches the outlet passage 30, while a portion will follow the dash arrows and rejoin the flow over the scroll 18 to be sucked back into the grinding chamber. It is believed that there are several flow paths which will be created by the present arrangement, all of which will improve the drying and the reduction of material in the grinding chamber. The divided vertical paths taken by the ground material and the drying medium gives the drying medium more time to effect its drying function.

The mill operation is such that a dense bed of material can be tolerated in the grinding chamber. As the bed accumulates it is mixed with drying air which is forced by the venturi action to enter the grinding chamber and assist in forcing the dense bed of material to move axially of the rotor shaft 14 to eventually emerge at the opposite side walls 11 of the grinding chamber. The material and air that reaches the side wall spaces 41 is able to be air lifted upwardly at the opposite side of the plenum chamber 27 and the expansion chamber 30 where it is thinned out by the incoming hot air medium which continues the drying process as the material is accelerated in the air lifting flow. The mass of ground material air lifted through the expansion chamber 30 and into the conduit section 32 contains a portion of oversize material which, on reaching the spinner separator fan blades 35, is forced centrifugally outwardly and drops by gravity to return through the conduit section 32 to enter the expansion chamber 30 and to be forced toward the center of the expansion chamber 30 by the rising flow of ground material at the side walls. Thus, the returning oversize material is guided directly toward the venturi throat 29 which is under a negative pressure as explained above and reenters the grinding chamber for further reduction. The action of the flow through the venturi throat is to increase the velocity of the air and the returning oversize material so that it mingles with the incoming material feed by the screw impeller 25 to assist in forcing the contents of the grinding chamber to move laterally along the shaft 14 and exit at the side wall faces 41. The characteristics of the mill as above described results in the progressive expulsion of the material during the grinding process, aided by the hot air supply, to eventually reach the side wall faces 41 and thereafter follow the rising flow pattern above referred to.

The present disclosure has set forth a preferred arrangement for carrying out the principles of this invention, and variations which accomplish the same or substantially the same purposes are to be included herein. One variation is to form only one side space by suitably widening the scroll liner so it abuts only one side wall.

What is claimed is:

1. Material grinding mill comprising:

a mill base frame having spaced side walls;

a rotary shaft operatively carried by an opposed pair of said side walls and a group of material grinding elements carried by said shaft in positions to be spaced from said pair of side walls;

a closed semi-cylindrical liner extending between said pair of side walls and enclosing the group of grinding elements;

a scroll liner forming a cylindrical shaped continuation of said closed liner and having side margins spaced from said pair of side walls, said scroll liner and said closed liner forming a generally cylindrical material grinding chamber having axially spaced openings adjacent said pair of side walls above said closed liner and said scroll liner having a marginal edge spaced above said closed liner to form a venturi opening to said grinding chamber;

a material feeder connected into said mill base frame to open centrally of said grinding chamber between said pair of side walls and adjacent said venturi opening of said scroll liner, said material feeder cooperating with said material grinding elements in said grinding chamber to cause material in said grinding chamber to progressively move axially and emerge at said axially spaced openings adjacent said pair of side walls;

a mill superstructure on said base frame providing a drying air inlet plenum in communication with said grinding chamber at said scroll liner venturi opening, and with ground material emerging at said axially spaced openings;

an expansion chamber in said mill superstructure in position to receive ground material air moved from said grinding chamber and positioned to generally direct air and ground material away from said grinding chamber; and ground material classifying means communicating with said expansion chamber for returning oversize material for passage back to said grinding chamber through said venturi inlet opening along with the drying medium.

2. The material grinding mill structure in claim 1 wherein said air inlet plenum directs incoming air across the air lifted flow of ground material from said axially spaced openings adjacent said pair of side walls.

3. The material grinding mill structure in claim 1 wherein said material grinding elements carried by said shaft rotate in a direction to move adjacent said scroll liner marginal edge to induce a suction effect at said inlet opening to return oversize material into said grinding chamber.

4. Material grinding mill comprising:

a housing having a base frame with spaced side walls, a front wall with an inlet and a movable rear wall to provide access to the housing interior;

a material grinding rotor mounted between said side walls such that the ends of said grinding rotor are spaced from said side walls;

a closed liner in said base frame forming a grinding chamber for holding material adjacent the grinding rotor, said liner extending the full width between said spaced side walls;

a scroll liner supported by said rear wall in position to cooperate with said closed liner to complete said grinding chamber by extending partly over said grinding rotor, said scroll liner having at least one side margin spaced from one of said side walls to provide an opening from said grinding chamber at said one side wall and a front margin spaced from said front wall adjacent said front wall inlet, said front margin being positioned to lie close to said grinding rotor to increase the velocity of material and air moving past said front margin and create a low pressure venturi throat zone;

an inlet passage adjacent said movable rear wall for admitting material drying hot air, said inlet passage directing the hot drying air over said scroll liner;

material feeding means connected to said front wall inlet to deliver material to said grinding chamber adjacent said scroll liner front margin and between the ends of said grinding rotor such that incoming material forces material being ground to move toward said one side wall;

said housing having a ground material expansion chamber extending outwardly from said scroll liner for directing ground material away from said grinding rotor, said outlet passage enclosing said venturi throat zone at said scroll liner front margin for inducing partly ground and oversized material and drying hot air to enter the orbit of said grinding rotor; and ground material classifying means communicating with said expansion chamber for returning oversize particles to said grinding chamber through said venturi throat zone.

5. The material grinding mill set forth in claim 4 wherein said scroll liner having a curving shape to progressively approach closer to said grinding rotor with said front margin closest to said grinding rotor for accelerating the velocity of material and hot drying air passing said front margin, whereby oversize particles are drawn down into said grinding chamber.

6. The material grinding mill set forth in claim 4 wherein said scroll liner front margin is formed with a bulbous surface approaching more closely to said grinding rotor than other surfaces of said scroll liner.

* * * * *